US009247804B2

(12) United States Patent
Butler

(10) Patent No.: US 9,247,804 B2
(45) Date of Patent: Feb. 2, 2016

(54) BROOM AND DETACHABLE WHISK BROOM

(71) Applicant: Casabella Holdings, LLC, Congers, NY (US)

(72) Inventor: Jeffrey Butler, Hawthorne, NY (US)

(73) Assignee: CASABELLA HOLDINGS, LLC, Congers, NY (US)

( * ) Notice: Subject to any disclaimer, the term of this patent is extended or adjusted under 35 U.S.C. 154(b) by 0 days.

(21) Appl. No.: 14/225,795

(22) Filed: Mar. 26, 2014

(65) Prior Publication Data

US 2015/0272310 A1 Oct. 1, 2015

(51) Int. Cl.

| | |
|---|---|
| ***A46B 7/04*** | (2006.01) |
| ***A46B 7/06*** | (2006.01) |
| ***A46B 5/00*** | (2006.01) |

(52) U.S. Cl.

CPC ..... *A46B 7/042* (2013.01); *A46B 5/0004* (2013.01); *A46B 5/0008* (2013.01); *A46B 5/0012* (2013.01); *A46B 5/0095* (2013.01); *A46B 7/04* (2013.01); *A46B 7/06* (2013.01); *A46B 2200/302* (2013.01)

(58) Field of Classification Search

CPC .... A46B 15/0055; A46B 7/04; A46B 5/0008; A46B 2200/302

USPC ..... 15/106, 159.1, 160

See application file for complete search history.

(56) References Cited

U.S. PATENT DOCUMENTS

| | | | | |
|---|---|---|---|---|
| 360,643 | A | 4/1887 | Austin | |
| 1,555,630 | A | 9/1925 | Brock | |
| 2,816,305 | A | 12/1957 | Kravitt | |
| 5,010,615 | A * | 4/1991 | Carter | 15/104.94 |
| 5,517,710 | A | 5/1996 | Hisey | |
| 5,778,479 | A * | 7/1998 | Raia | 15/202 |
| 5,839,145 | A | 11/1998 | Petner | |
| D433,571 | S | 11/2000 | Ancona | |
| D468,106 | S | 1/2003 | Robertson | |
| 6,971,138 | B2 | 12/2005 | Berti | |
| 7,000,281 | B1 * | 2/2006 | Morad | A46B 5/02 15/106 |
| D521,201 | S | 5/2006 | Iachetti | |
| 7,895,696 | B2 | 3/2011 | Belmonte | |
| 8,087,514 | B1 | 1/2012 | Fulford | |
| 2004/0031116 | A1 * | 2/2004 | Coleman | 15/172 |
| 2006/0230560 | A1 | 10/2006 | Sampaio | |
| 2007/0089259 | A1 | 4/2007 | Jones | |
| 2009/0223007 | A1 | 9/2009 | Li | |
| 2010/0154824 | A1 * | 6/2010 | Vosbikian et al. | 134/6 |

FOREIGN PATENT DOCUMENTS

| | | |
|---|---|---|
| JP | 10075925 | 9/1996 |

* cited by examiner

*Primary Examiner* — Monica Carter
*Assistant Examiner* — Stephanie Berry
(74) *Attorney, Agent, or Firm* — Curtis, Mallet-Prevost, Colt & Mosle LLP

(57) ABSTRACT

A broom and detachable whisk broom are disclosed where a broom head with bristles has a discontinuous perimeter with an opening to receive a detachable whisk broom. The detachable whisk broom has bristles that create a continuous multiplicity of bristles when inserted in the broom head. The opening in the broom head has a linear guide that aligns with a linear guide of the whisk broom. A tab receiver on the broom head receives and positively engages a tab and spring hinge arrangement on the whisk broom to create the appearance and utility of a one piece broom head with the advantages of a quickly detachable whisk broom.

19 Claims, 6 Drawing Sheets

BROOM AND DETACHABLE WHISK BROOM

BACKGROUND OF THE INVENTION

1. Field of the Invention

This invention relates generally to cleaning devices, and more specifically to a broom and detachable whisk broom.

2. Description of Related Art

Brooms are common cleaning devices that have been used for hundreds if not thousands of years. Bundles of natural material such as twigs, grass, and corn husks were used in ancient times to clean floors and hearth areas. A popular material was branches of broom, a yellow flowering shrub. As civilization advanced, broom making became a skilled trade with artisans known as "besom squires" in Anglo-Saxon England. Besom being the name for a cleaning tool consisting of a bundle of sticks or twigs used to whisk dirt away.

In the United States, a species of Sorghum known as broomcorn became the standard material for brooms in the northeastern United States, and an industry was born. The Shakers, a Christian religious sect that excelled at handicrafts, perfected various broom styles including the flat broom and the whisk broom.

With modern day materials such as plastics, many brooms are now made entirely from plastic, although there still remains a thriving demand for natural fiber brooms. Whether natural fibers or plastic, brooms typically are made with a handle to allow the user to operate the broom without bending over. There are also, however, specialized brooms known as whisk brooms or dusters that do not have handles, and are used to remove dirt and other unwanted materials from small areas or objects such as tables, clothing, a small area of a floor, and the like. There are also times when a broom with a handle is needed for a particular cleaning job as well as a whisk broom. On these occasions, both style brooms are maintained and used. When a whisk broom is needed while a handled broom is being used, the user usually stops work with the handled broom, locates the whisk broom, brings the whisk broom to the area of use, and once finished using the whisk broom, returns it to where it came from. Such an approach can waste time, especially if the whisk broom is not readily at hand or cannot be easily located.

What is needed is a handled broom that can also be used as a whisk broom.

It is thus an object of the present invention to provide a broom with a detachable whisk broom. It is another object of the present invention to provide a broom with a whisk broom that forms a detachable part of the broom where the whisk broom bristles become part of the broom bristles when attached to one another.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a broom and detachable whisk broom comprising a broom head comprising a top side having a pole receiver for attachment to a pole and a bottom side with bristles attached; the broom head having a discontinuous perimeter partially encompassing the bottom side with an opening to receive a detachable whisk broom; the opening in the broom head having a linear guide; a tab receiver located proximate the opening in the broom head for receiving and positively engaging a tab on the detachable whisk broom; and a detachable whisk broom comprising a whisk broom head having atop side for insertion into the opening of the broom head and a bottom side with bristles attached; the whisk broom head comprising a tab for retention in the tab receiver of the broom head wherein the tab is operatively connected to a spring hinge such that the tab is located within an aperture in the whisk broom head and moves in an axis perpendicular to the surface of the whisk broom head; the whisk broom head having a linear guide for engagement with the linear guide of the broom head.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
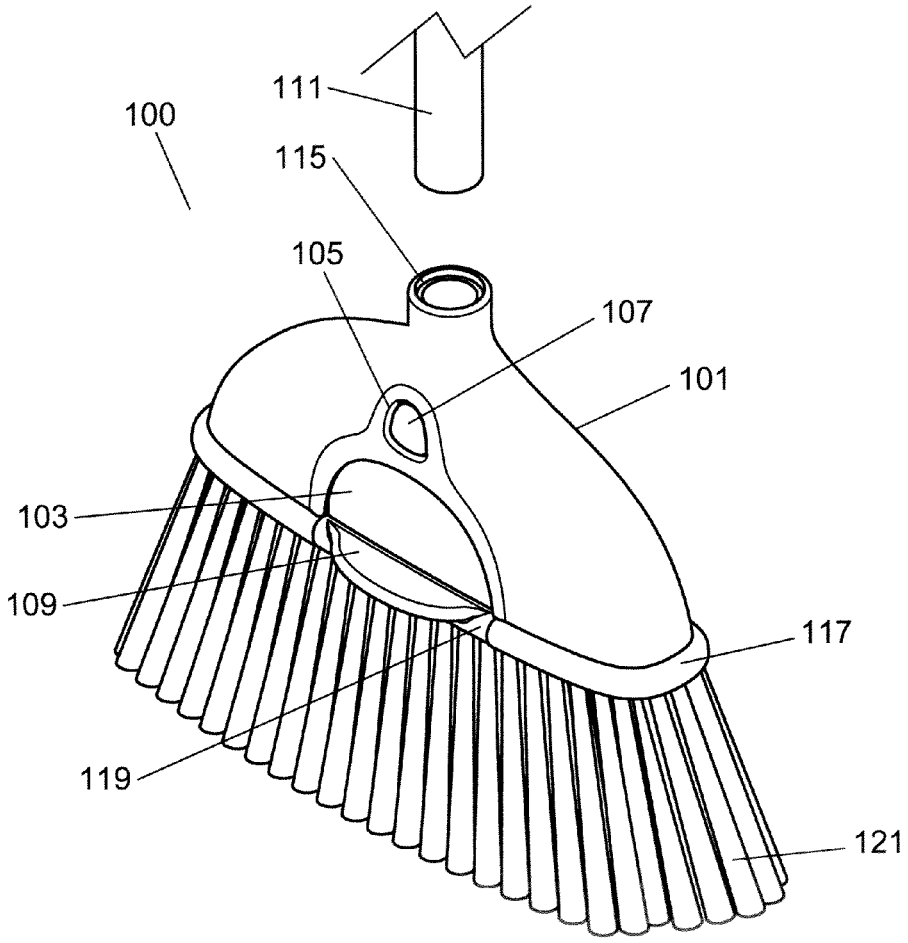
FIG. 1 is a perspective view of a broom and detachable whisk broom.

The attached figures depict various views of the broom and detachable whisk broom in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Broom and Detachable Whisk Broom are described and depicted by way of this specification and the attached drawings.

For a general understanding of the present invention, reference is made to the drawings. In the drawings, like reference numerals have been used throughout to designate identical elements.

Referring to FIG. 1, a perspective view of the broom and detachable whisk broom 100 is shown. The broom and detachable whisk broom may be made from any suitable rigid or semi-rigid material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used. The various components of the broom and detachable whisk broom may be made by injection molding, blow molding, machining, extruding, or the like. The broom head 101 can be seen in FIG. 1 as having a top side having a pole receiver 115 for attachment to a pole 111. The pole 111 may be made from a metal, plastic, or the like, and may be attached to the pole receiver 115 with threads, rivets, friction fittings, screws, indentations, or the like. The broom head, in some embodiments of the present invention, has a curved top side. The bottom side of the broom head 101 has bristles 121 attached thereto. The bristles may be made from a synthetic material such as nylon or other plastic, or may, in some embodiments of the present invention, be made from a natural fiber. The broom head 101 has a discontinuous perimeter that partially encompasses the bottom side and has an opening to receive a detachable whisk broom 103. The broom head 101 also has a tab receiver 105 located proximate the opening in the broom head for receiving and positively engaging a tab 107 on the detachable whisk broom. The tab receiver 105 may, in some embodiments of the present invention, have an oval or rounded shape, or may appear as an elliptical or other geometric shape, and is an opening in the broom head 101. The tab 107 is complimentary in shape to the tab receiver 105 and positively engages the tab 107 on the detachable whisk broom once the tab 107 is received in the tab receiver 105. In some embodiments of the present invention, the broom head 101 further comprises a perimeter lip 117. The perimeter lip 117 may be rounded or oval and may appear as a beading around the perimeter of the broom head 101. The detachable whisk broom 103 also may have a perimeter lip 119 that is similar in shape and orientation to the broom head perimeter lip 117, and creates a continuous perimeter lip with the broom head when the detachable whisk broom 103 is inserted in the broom head 101. When the detachable whisk broom 103 is inserted in the broom head 101, the bristles of the broom head and the bristles of the detachable whisk broom form a continuous multiplicity of bristles. The bristles may be arranged in a pattern or other geometry, and may, in some embodiments of the present invention, be angled or otherwise oriented.

The detachable whisk broom 103 has a top side for insertion into the opening of the broom head and a bottom side with bristles attached. The whisk broom head (see FIG. 7 for an unobstructed view of the whisk broom head 711) has a tab 107 for retention in the tab receiver 105 of the broom head 101 wherein the tab 107 is operatively connected to a spring hinge (see FIG. 7) such that the tab is located within an aperture in the whisk broom head and moves in an axis perpendicular to the surface of the whisk broom head. An extractor lip 109 can also be seen in FIG. 1 generally perpendicular to the perimeter of the detachable whisk broom. The extractor lip 109 may also be located close to, or generally above, the whisk broom perimeter lip 119. The whisk broom extractor lip 109 may also, in some embodiments of the present invention, have a curved horizontal perimeter.

Figure 2:
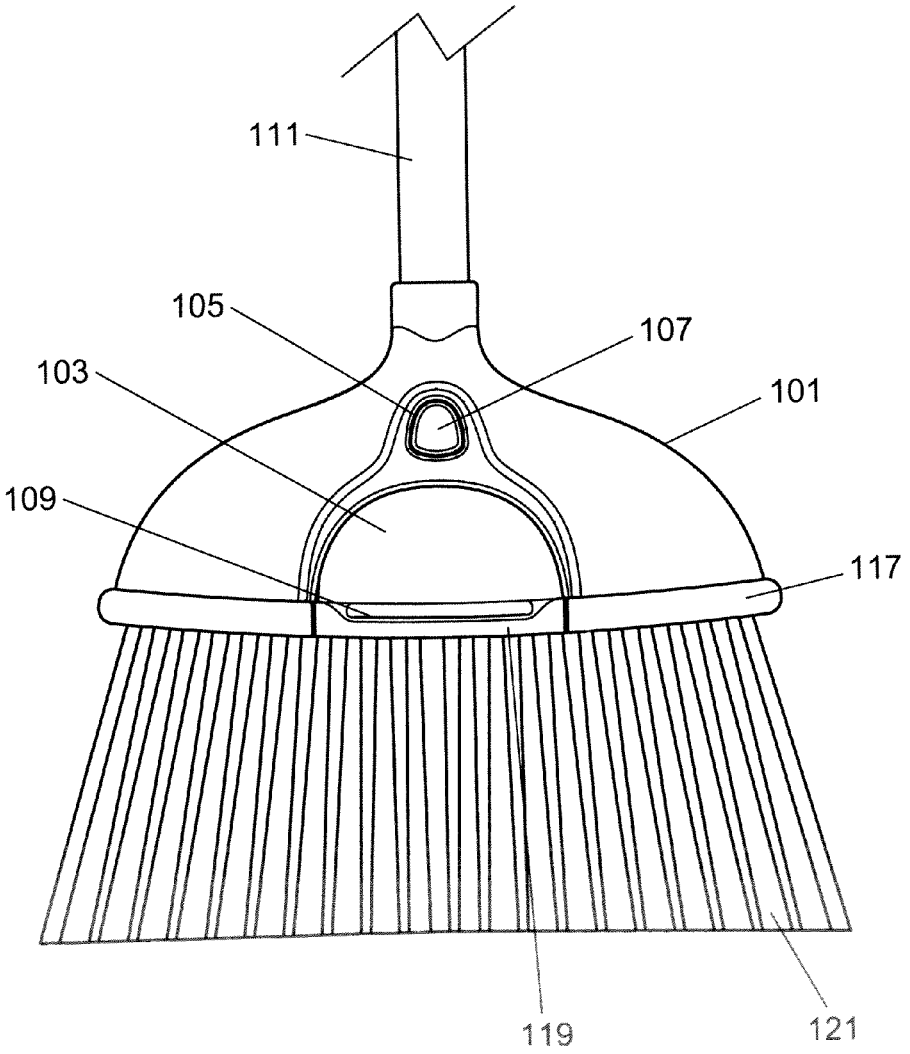
FIG. 2 is a plan view of the broom and detachable whisk broom.

FIG. 2 is a plan view of the broom and detachable whisk broom that clearly shows the detachable whisk broom 103 inserted in the broom head 101 and positively retained through the interaction of the tab 107 and the tab receiver 105.

Figure 3:
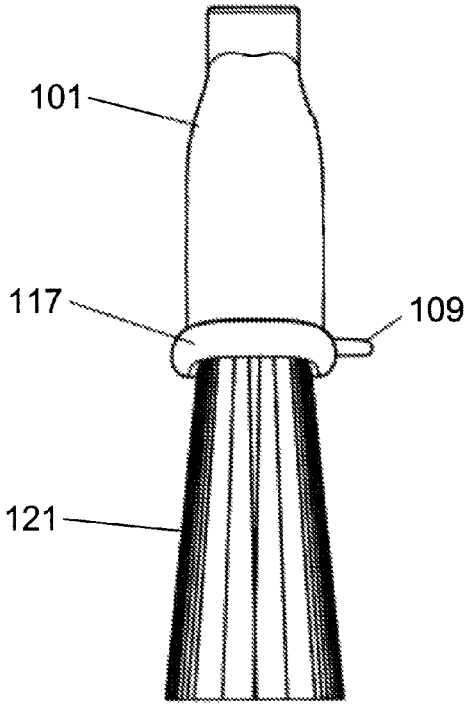
FIG. 3 is a left side view of the broom and detachable whisk broom.
Figure 4:
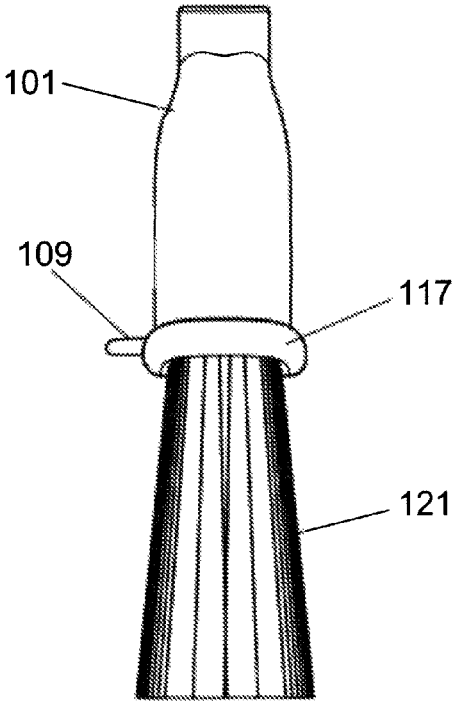
FIG. 4 is a right side view of the broom and detachable whisk broom.

FIG. 3 is a left side view of the broom and detachable whisk broom and FIG. 4 is a right side view of the broom and detachable whisk broom. The whisk broom extractor lip 109 can be clearly seen in both views, and facilitates ease of removal and installation of the detachable whisk broom 103 in the broom head 101.

Figure 5:
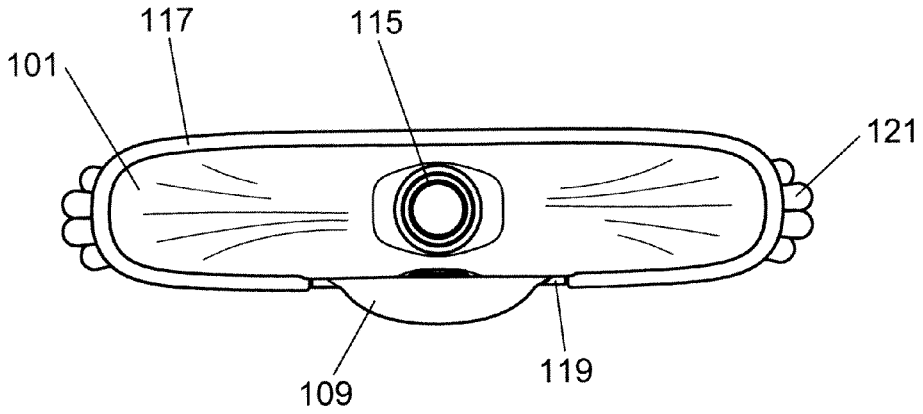
FIG. 5 is a top plan view of the broom and detachable whisk broom.
Figure 6:
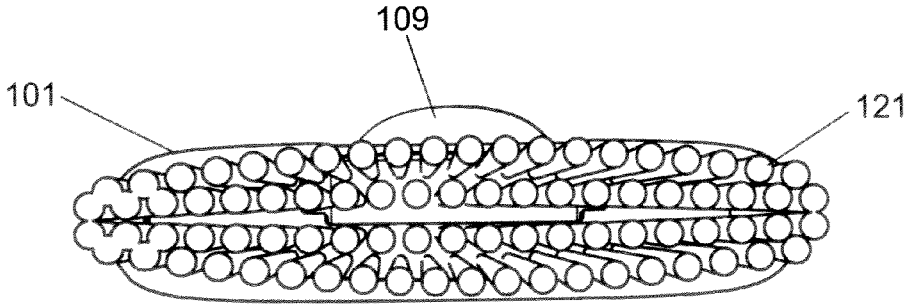
FIG. 6 is a bottom plan view of the broom and detachable whisk broom.

FIG. 5 is a top plan view of the broom and detachable whisk broom and FIG. 6 is a bottom plan view of the broom and detachable whisk broom. The bristles 121 can be clearly seen in one exemplary configuration. Other configurations, orientations, arrangements, as well as various bristle thicknesses are considered to be within the scope and content of the present invention.

To use the broom and detachable whisk broom, with the detachable whisk broom 103 coupled to the broom head 101, the broom and detachable whisk broom are used like a traditional broom to sweep floors or other surface areas free of dirt and debris. Sweeping simply involves moving the handle or pole of the broom such that the broom head moves across the surface to be cleaned and in doing so moves the dirt and debris in a desired direction so that the dirt and debris can be removed with a dustpan or the like. To use the detachable whisk broom 103 independent of the broom head 101, the tab 107 is depressed and the whisk broom 103 is pulled downward by securely gripping a portion of the whisk broom 103 such as the whisk broom extractor lip 109. The detachable whisk broom 103 may, in some embodiments of the present invention, have a curved top side. To use the detachable whisk broom of the present invention, the detachable whisk broom 103 is grasped and moved in a desired direction across the surface to be cleaned, thus moving dirt and debris to a location where the dirt and debris can then be removed by a dustpan for example.

Figure 7:
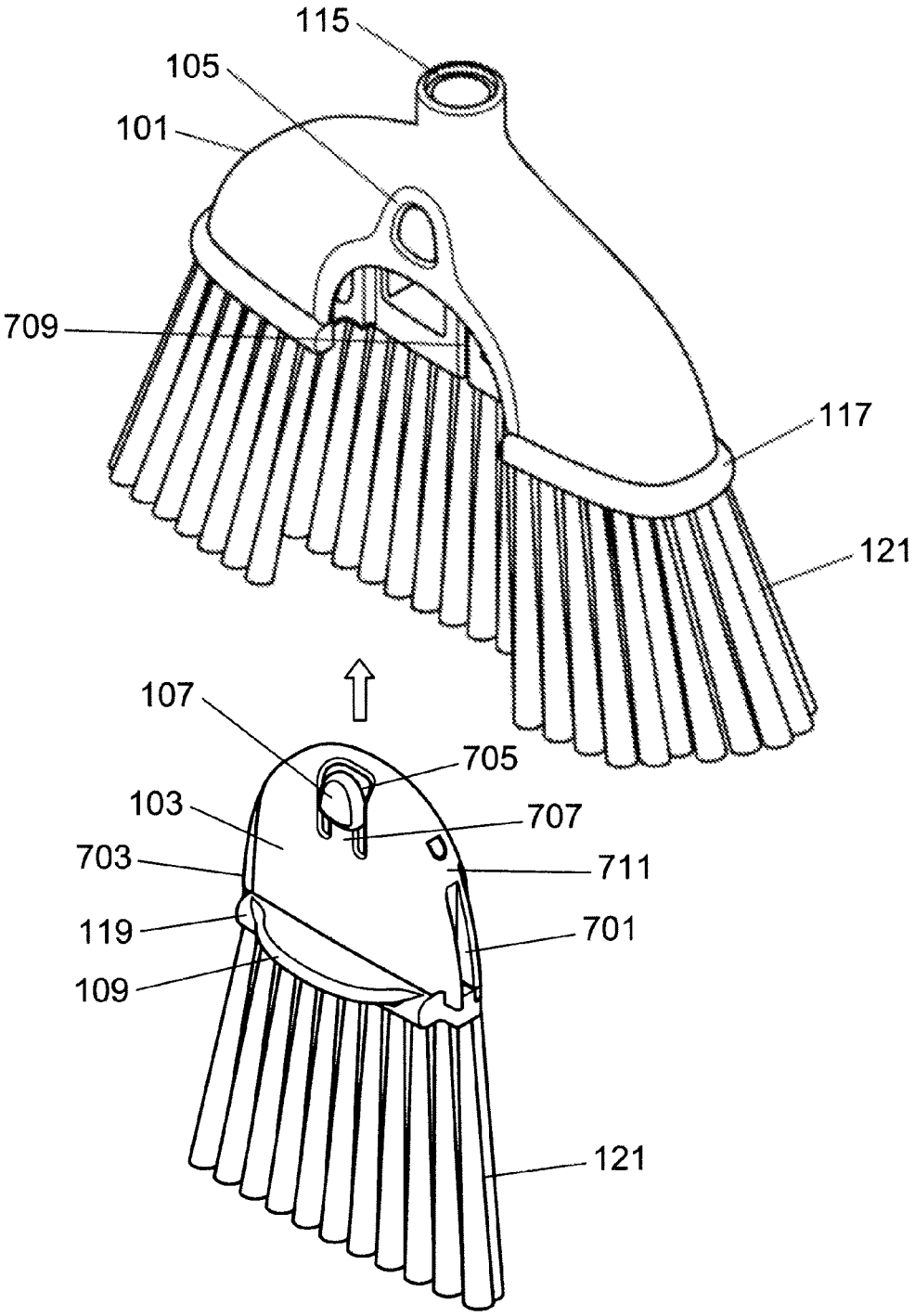
FIG. 7 is an exploded perspective view of the broom and detachable whisk broom.
Figure 8:
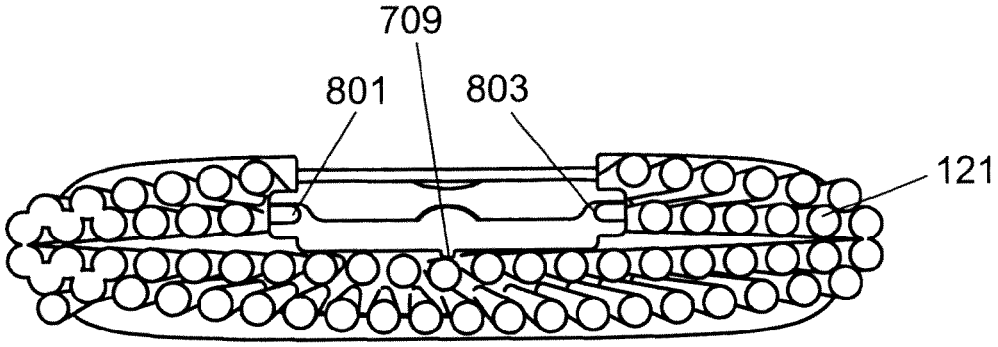
FIG. 8 is a bottom plan view of the broom with the whisk broom detached.
Figure 9:
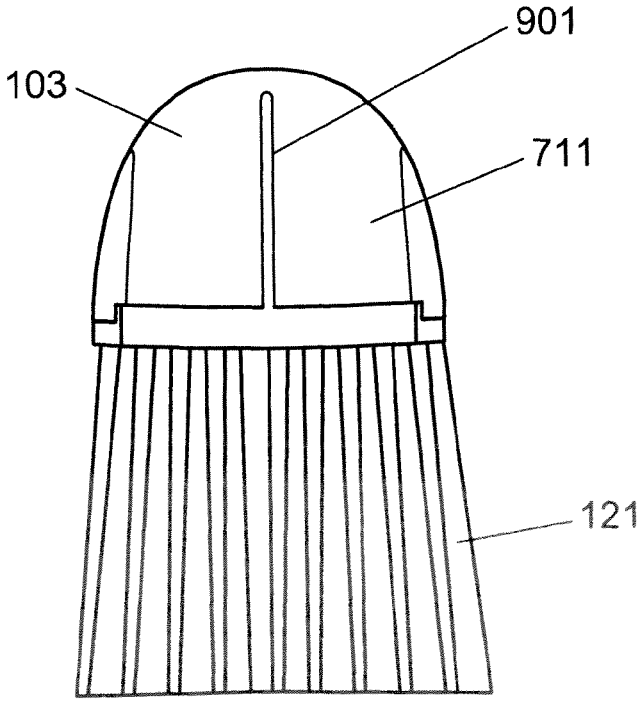
FIG. 9 is a plan view of the whisk broom detached from the broom.

FIG. 7 is an exploded perspective view of the broom and detachable whisk broom. The arrow above the detachable whisk broom indicates the direction that the detachable whisk broom 103 must move in order to be secured by the broom head 101. The whisk broom head 711 can be seen with bristles 121 attached. When the detachable whisk broom 103 is inserted in the broom head 101, the tab 107 is retained by the tab receiver 105. The tab 107 protrudes outward from the surface of the whisk broom to allow for positive engagement with the tab receiver 105 of the broom head 101. The tab 107 is attached to, or integrally molded with, a spring hinge 707. The spring hinge 707 is a generally planar structure that is attached at one side to the whisk broom at a side of a tab aperture 705. The tab aperture 705 is an opening in the detachable whisk broom 103 that may, in some embodiments of the present invention, be rectangular. The spring hinge 707 restricts the movement of the tab 107 to an axis that is perpendicular to the surface of the whisk broom 103 and also provides force that keeps the tab 107 in the tab receiver 105. To facilitate proper insertion and alignment of the detachable whisk broom 103 into the opening in the broom head 101, the opening in the broom head 101 has a linear guide and the detachable whisk broom 103 also has a complimentary linear guide for engagement with the linear guide of the broom head 101. In some embodiments of the present invention, the linear guide of the detachable whisk broom 103 comprises a first guide slot 701 and a second guide slot 703. These guide slots may be located at either end of the detachable whisk broom along a vertical periphery of the detachable whisk broom. These guide slots may be rectangular, and engage with the first guide 801 and the second guide 803 of the broom head as depicted in FIG. 8. In some embodiments of the present invention, a third guide slot 709 is located in the opening of the broom head 101 with a generally linear shape and vertical orientation. The third guide slot 709 engages with a third guide 901 of the detachable whisk broom 103 as seen in FIG. 9. In some embodiments of the present invention, the linear guides of the broom head 101 and the detachable whisk broom 103 are generally rectangular in shape.

FIG. 8 is a bottom plan view of the broom with the whisk broom detached showing clearly the first guide 801, the second guide 803, and the third guide slot 709. These linear guides may be modified in quantity, shape, length, and structure. For example, guides and guide slots may be interchanged between the broom head 101 and the detachable whisk broom 103.

Lastly, FIG. 9 is a plan view of the whisk broom detached from the broom. The third guide 901 can be clearly seen. Modifications, additions, or deletions to the linear guides may be made, and are considered to be within the spirit and broad scope of the present invention and the various embodiments described and envisioned herein.

It is, therefore, apparent that there has been provided, in accordance with the various objects of the present invention, a broom and detachable whisk broom. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A broom and detachable whisk broom comprising:

a broom head comprising a top side having a pole receiver for attachment to a pole and a bottom side with bristles attached; wherein the pole receiver has an axis that is parallel with the axis of an attached pole; the broom head having a discontinuous perimeter forming a perimeter lip and partially encompassing the bottom side with an opening to receive a detachable whisk broom; the opening in the broom head having a linear guide that is generally parallel with the axis of the pole receiver; a tab receiver comprising an opening through the broom head and located proximate the opening in the broom head for receiving and positively engaging a tab on the detachable whisk broom; and a detachable whisk broom comprising a whisk broom head having a top side for insertion into the opening of the broom head and a bottom side with bristles attached and having a perimeter lip; the whisk broom head comprising a tab for retention in the tab receiver of the broom head wherein the tab is operatively connected to a spring hinge such that the tab is located within an aperture in the whisk broom head and moves in an axis perpendicular to a surface of the whisk broom head and wherein the tab is complimentary in shape to the tab receiver of the broom head; the whisk broom head having a linear guide capable of engaging with the linear guide of the broom head when aligned and inserted in an orientation that is generally parallel with the axis of the pole receiver of the broom head.

2. The broom and detachable whisk broom of claim 1, wherein the linear guide of the broom head further comprises a first guide having a generally linear shape and a second guide having a generally linear shape.

3. The broom and detachable whisk broom of claim 2, wherein the linear guide of the broom head further comprises a third guide slot having a generally linear shape.

4. The broom and detachable whisk broom of claim 1, wherein the linear guide of the broom head further comprises a third guide slot having a generally linear shape.

5. The broom and detachable whisk broom of claim 1, wherein the broom head further comprises a perimeter lip.

6. The broom and detachable whisk broom of claim 1, wherein the whisk broom further comprises a perimeter lip that creates a continuous perimeter lip with the broom head when the whisk broom is inserted in the broom head.

7. The broom and detachable whisk broom of claim 1, wherein the whisk broom further comprises an extractor lip.

8. The broom and detachable whisk broom of claim 1, wherein the linear guide of the whisk broom head further comprises a first guide slot for engagement with the first guide of the broom head.

9. The broom and detachable whisk broom of claim 8, wherein the linear guide of the whisk broom head further comprises a second guide slot for engagement with the second guide of the broom head.

10. The broom and detachable whisk broom of claim 1, wherein the linear guide of the whisk broom head further comprises a third guide for engagement with the third guide slot of the broom head.

11. The broom and detachable whisk broom of claim 1, further comprising a pole connected to the pole receiver of the broom head.

12. The broom and detachable whisk broom of claim 1, wherein the whisk broom head has a curved top side.

13. The broom and detachable whisk broom of claim 7, wherein the whisk broom extractor lip of the whisk broom head is generally perpendicular to the whisk broom head.

14. The broom and detachable whisk broom of claim 13, wherein the whisk broom extractor lip of the whisk broom head has a curved horizontal perimeter.

15. The broom and detachable whisk broom of claim 7, wherein the whisk broom extractor lip of the whisk broom head has a curved horizontal perimeter.

16. The broom and detachable whisk broom of claim 1, wherein the bristles of the broom head and the bristles of the detachable whisk broom form a continuous multiplicity of bristles when the detachable whisk broom is inserted in the broom head.

17. The broom and detachable whisk broom of claim 1, wherein the perimeter lip of the broom head and the perimeter lip of the whisk broom form a continuous perimeter lip when the detachable whisk broom is inserted in the broom head.

18. The broom and detachable whisk broom of claim 1, wherein the broom head has a curved top side.

19. A detachable whisk broom comprising:

a whisk broom head having a top side for insertion into the opening of a broom head and a bottom side with bristles attached and having a perimeter lip; the whisk broom head comprising a tab for retention in the tab receiver of a broom head wherein the tab is operatively connected to a spring hinge such that the tab is located within an aperture in the whisk broom head and moves in an axis perpendicular to a surface of the whisk broom head and wherein the tab is complimentary in shape to the tab receiver of a broom head;

the whisk broom head having a linear guide capable of engaging with a linear guide of a broom head when aligned and inserted in an orientation that is generally parallel with the axis of a pole receiver of the broom head.

* * * * *